US007905077B2

(12) United States Patent
Yokota et al.

(10) Patent No.: US 7,905,077 B2
(45) Date of Patent: Mar. 15, 2011

(54) TRANSPORT APPARATUS AND BOXING APPARATUS PROVIDED WITH SAME

(75) Inventors: Yuji Yokota, Shiga (JP); Takashi Kimura, Shiga (JP); Seisaku Iwasa, Shiga (JP)

(73) Assignee: Ishida Co., Ltd., Kyoto (JP)

( * ) Notice: Subject to any disclaimer, the term of this patent is extended or adjusted under 35 U.S.C. 154(b) by 154 days.

(21) Appl. No.: 12/373,431

(22) PCT Filed: Jul. 12, 2007

(86) PCT No.: PCT/JP2007/063910

§ 371 (c)(1),
(2), (4) Date: Jan. 12, 2009

(87) PCT Pub. No.: WO2008/007739

PCT Pub. Date: Jan. 17, 2008

(65) Prior Publication Data

US 2009/0308024 A1 Dec. 17, 2009

(30) Foreign Application Priority Data

Jul. 13, 2006 (JP) ..... 2006-193135

(51) Int. Cl.
*B65B 63/02* (2006.01)
*B65G 21/20* (2006.01)

(52) U.S. Cl. ..... 53/523; 53/251; 198/836.1

(58) Field of Classification Search ..... 53/523, 53/529, 532, 244, 246, 251; 198/836.1
See application file for complete search history.

(56) References Cited

U.S. PATENT DOCUMENTS

| | | | | | |
|---|---|---|---|---|---|
| 3,537,230 | A * | 11/1970 | Dorfmann | 53/529 |
| 3,540,180 | A * | 11/1970 | Sage et al. | 53/501 |
| 5,284,003 | A * | 2/1994 | Goodman et al. | 53/437 |
| 5,588,285 | A * | 12/1996 | Odenthal | 53/534 |
| 5,664,407 | A * | 9/1997 | Cooper et al. | 53/542 |
| 5,768,856 | A * | 6/1998 | Odenthal | 53/443 |
| 5,802,820 | A * | 9/1998 | Romagnoli | 53/525 |
| 5,855,105 | A * | 1/1999 | Ferris | 53/475 |
| 5,881,532 | A * | 3/1999 | Kitagawa | 53/54 |
| 6,094,888 | A * | 8/2000 | Pazdernik et al. | 53/436 |
| 6,594,974 | B2 * | 7/2003 | Theriault | 53/500 |
| 6,694,706 | B1 * | 2/2004 | Odenthal et al. | 53/443 |
| 6,708,465 | B1 * | 3/2004 | Gustafsson | 53/463 |
| 7,137,234 | B2 * | 11/2006 | Caporali et al. | 53/433 |
| 7,587,879 | B2 * | 9/2009 | Guttinger et al. | 53/251 |
| 7,721,511 | B2 * | 5/2010 | De Matteis | 53/399 |
| 2004/0149767 | A1 * | 8/2004 | Boehm et al. | 221/25 |

FOREIGN PATENT DOCUMENTS

| | | | |
|---|---|---|---|
| JP | H11-130231 | A | 5/1999 |
| JP | 2004-315114 | A | 11/2004 |
| JP | 2005-029276 | A | 2/2005 |
| JP | 2005-119723 | A | 5/2005 |

* cited by examiner

*Primary Examiner* — Paul R Durand
(74) *Attorney, Agent, or Firm* — Global IP Counselors, LLP

(57) ABSTRACT

A transport apparatus for transporting an article, which is a bag formed from a flexible packaging material, includes a first transport part and a second transport part. The first transport part is configured and arranged to transport the article in a predetermined transport direction with the article being supported from below by a transport surface of the first transport part. The second transport part is configured and arranged to transport the article in the predetermined transport direction while exerting a downward force on a portion of an upper surface of the article being transported by the first transport part.

13 Claims, 13 Drawing Sheets

TRANSPORT APPARATUS AND BOXING APPARATUS PROVIDED WITH SAME

CROSS-REFERENCE TO RELATED APPLICATIONS

This national phase application claims priority to Japanese Patent Application No. 2006-193135 filed on Jul. 13, 2006. The entire disclosure of Japanese Patent Application No. 2006-193135 is hereby incorporated herein by reference.

TECHNICAL FIELD

The present invention relates to a transport apparatus for transporting articles, and to a boxing apparatus provided with the transport apparatus.

BACKGROUND ART

In general, articles such as snacks are gathered in a predetermined number in a predetermined orientation, and are thereafter boxed in a cardboard box or the like and shipped.

There is a need to increase the transport speed of the transport apparatus used in such boxing work or the like in order to improve productivity.

For example, Japanese Laid-open Patent Application No. 2004-315114 discloses a transport apparatus for speedily transporting cup-style instant noodle containers whose shapes of the side surfaces are not parallel.

DISCLOSURE OF THE INVENTION

However, the conventional transport apparatus described above has problems such as the following.

In other words, in the transport apparatus disclosed in the publication noted above, the transport object is a cup-style instant noodle container having a generally trapezoid cross sectional shape. Accordingly, a nipping conveyors must be set in a V-shape (i.e., a state in which the surfaces of the two conveyors in contact with the container are facing diagonally upward) as viewed from the transport direction and disposed on a belt conveyor. For this reason, it may be impossible to suitably keep the articles from being displacement in the upward direction and to transport the articles while holding the articles in a predetermined orientation during transport.

An object of the present invention is to provide a transport apparatus that can considerably improve productivity by smoothly transporting articles while maintaining a predetermined orientation.

The transport apparatus according to a first aspect is an apparatus for transporting an article, which is a bag formed from a flexible material. The transport apparatus has a first transport part and a second transport part. The first transport part is configured and arranged to transport the article in a predetermined transport direction while supporting the article from below by a transport surface of the first transport part. The second transport part is configured and arranged to transport the article in the predetermined transport direction while exerting a downward force on a portion of an upper surface of the article being transported by the first transport part. A conveyor or a transport roller can be used as the first and second transport parts.

Ordinarily, food products or other articles bagged in a bag formed by a flexible material are transported while the lower surfaces of the articles are supported by a conveyor, for example. With such a conveyor, there is a need to transport the articles at a higher transport speed in order to improve productivity. However, when the transport speed is greater than a predetermined speed, a phenomenon occurs in which the articles stand erect on the transport surface of the conveyor (the so-called wheelie phenomenon), or a phenomenon occurs in which the articles rotate in the direction parallel to the transport surface (hereinafter referred to as the lateral direction) on the transport surface of the conveyor in the case that the articles are delivered between two conveyors, or in the case that the articles are delivered from a conveyor to a downstream delivery mechanism, for example. Therefore, the articles cannot be transported in a predetermined orientation. In view of the above, the conventional method with such a conveyor had a guide installed substantially vertically at the two sides of the conveyor along the predetermined transport direction to reduce the displacement of the articles in the lateral direction, and to set the articles in a predetermined orientation when the articles are delivered to the next step, for example.

However, when such a guide is provided to the transport apparatus, the transport speed of the articles is reduced by frictional resistance because the articles are transported while making contact with the guide, and the pitch, i.e., transport interval at which the articles are transported is disrupted. Also, with such a guide, it is not possible to reduce the displacement of the transported articles in the upward direction, i.e., the direction substantially vertically upward with respect to the transport surface. Therefore, the articles stand erect and may become incapable of being transported in a predetermined orientation.

In view of the above, in the transport apparatus according to the present invention, the second transport part for transporting an article while applying a downward force on a portion of the upper surface of the article is provided in addition to the first transport apparatus for supporting and transporting the article from below, as described above. A state in which the article stands erect (wheelie phenomenon) can thereby be reduced even when the transport speed of the first transport part is increased.

It is preferred that a pair of transport sections be provided as the second transport part. The pair of transport sections is configured and arranged to contact with two ends or a portion near two ends of the article in a direction (hereinafter referred to as the width direction of the article) orthogonal to the predetermined transport direction. When such a pair of transport sections is used, the wheelie phenomenon can be more reliably reduced and a force is not exerted from above in the center portion of the width direction of the articles. Therefore, a secondary effect can also be obtained in that the contents are brought to the center when distribution of the contents within the bag formed from a flexible material is unbalanced.

The pair of transport sections, which is the second transport part, can be configured so as to have a first transport surface configured and arranged to contact with one of the ends or a portion near the one of the ends of the article in the width direction of the article, and a second transport surface configured and arranged to contact with the other of the ends or a portion near the other of the ends of the article in the width direction of the article. At least one of the first transport surface and the second transport surface forms an acute angle with respect to the transport surface of the first transport part. In accordance with such a pair of transport sections, at least one surface among the first transport surface and the second transport surface exerts a downward force on a portion of the upper surface of the articles. The pair of transport surfaces is designed so that the angle formed by the first transport surface with the transport surface of the first transport part and the angle formed by the second transport surface with the transport surface of the first transport part are acute angles, whereby the articles are transported while the pair of transport sections makes contact diagonally from above with each of the articles. Therefore, disrupted transport intervals of the articles due to lower transport speed and displacement in the lateral and upward directions of the articles can be reduced. The angle formed by the first or second transport surfaces is preferably 75° or more and 85° or less with consideration given to the transport speed and the stability of the orientation of the articles during transport.

In addition to a first transport part and a second transport part, the transport apparatus may be provided with a third transport part. The third transport part is configured and arranged to transport the article while exerting a downward force on the article between the first transport surface and the second transport surface of the second transport part. By adding such a third transport part, the wheelie phenomenon of an article can be reliably reduced by the third transport part even when the downward force exerted on the article from the first and second transport surfaces of the second transport part is set to a low level.

The transport apparatus is preferably provided with a controller configured to automatically modify at least one of the position and the orientation of the second transport part. The controller may control on the basis of article identification information related to the shape of the article, and may determine the suitable position and orientation of the second transport part from the article identification information that specifies an article. In the case that the position and orientation of the second transport part is determined from the article identification information, the controller is configured to obtain information that associates the article identification information with the position or orientation of the second transport part.

It is also possible to configure that the second transport part has a plurality of surfaces that make contact with an article, and the angles formed by these surfaces of the second transport part with the transport surface of the first transport part are not equal. For example, the second transport part has a left-side transport surface configured and arranged to contact with a portion of the left side of the article when viewed from the upstream side toward the downstream side of the predetermined transport direction, and a right-side transport surface configured and arranged to contact with a portion of the right side of the article when viewed from the upstream side toward the downstream side of the predetermined transport direction, and the left-side transport surface and the right-side transport surface are each divided into a plurality of units in the predetermined transport direction thereof. In accordance with such a configuration, the second transport part is provided with at least a pair of first left-side and right-side transport surfaces and a pair of second left-side and right-side transport surfaces. The orientation of the pair of first left-side and right-side transport surfaces and the pair of second left-side and right-side of transport surfaces in relation to the transport surface of the first transport part is made to be different, whereby the direction of the force received by the article from the second transport part is varied in each position of the predetermined transport direction. Therefore, when distribution of the contents in the bag formed from a flexible material is unbalanced, the unbalance can be effectively eliminated.

The left-side transport surface and the right-side transport surface of the second transport part are preferably divided into N number of units in the predetermined transport direction, whereby the pairs of transport surfaces from first left-side and right-side transport surfaces to Nth left-side and right-side transport surfaces are aligned along the predetermined transport direction. At least one pair among the pairs of transport surfaces from the first left-side and right-side transport surfaces to the Nth left-side and right-side transport surfaces has a different orientation from the orientation of the other pairs in relation to the transport surface of the first transport part. Furthermore, the sum of the angles formed by the first left-side transport surface to the Nth left-side transport surface with respect to the transport surface of the first transport part is preferably substantially equal to the sum of the angles formed by the first right-side transport surface to the Nth right-side transport surface with respect to the transport surface of the first transport part. Therefore, the force applied to the left side portion of the article by the second transport part overall and the force applied to the right side portion of the article by the second transport part overall are set in opposition. The displacement of the article in the width direction can be reduced during transport of the article while eliminating displacement of the contents of the article.

There are cases in which it is preferred that the article transport speed of the second transport part be greater than the article transport speed of the first transport part. In this case, a portion of the upper surface of the article can be pressed with a strong downward force. When the article inclined more than a predetermined orientation enters the transport apparatus, the orientation of the article can be returned to a normal orientation. Specifically, the transport speed of the second transport part is set to be approximately, e.g., 5 m/min higher than the transport speed of the first transport part.

It is preferred that the transport apparatus of the present invention be further provided with an adjustment mechanism configured and arranged to adjust the mounting position of the second transport part in a direction orthogonal to the predetermined transport direction. The second transport part can be moved to a suitable position in accordance with the size of the article in the case that an adjustment mechanism is provided.

Bagged products in which snacks or the like are bagged are an example of such articles, which are bags formed from a flexible material. In the case of such articles, the thickness (the dimension in the height direction) is often different between the center portion and the end portions in the width direction of the articles, and the contents may become concentrated in the end portions. However, in the transport apparatus of the present invention, it can be expected that the unbalance will be alleviated by the force exerted on the articles by the second transport part.

Specifically, there are cases in which distribution of the snacks inside the bags becomes unbalanced on the upstream side or downstream side of the predetermined transport direction, or in the direction orthogonal (width direction) to the predetermined transport direction, for example. Transporting the bags in such a state can lead to the phenomena in which the bags stand erect or rotate. However, in the transport apparatus of the present invention, the articles (bags) can be transported while diagonally pressing downward in the vicinity of the two end portions of the bag where the thickness is low in the case that, e.g., the thickness of the end portions of the bags in the width direction is less than that of the center portions.

The transport apparatus described above can be used as a boxing apparatus in combination with a delivery mechanism and a boxing mechanism. The delivery mechanism is configured and arranged to receive the articles from the transport apparatus and sequentially aligns the articles in an erect orientation in a predetermined position. The boxing mechanism is configured and arranged to box the articles sequentially aligned in the erect orientation in the predetermined position into a predetermined box. In such a boxing apparatus, productivity can be considerably improved because the articles can be smoothly transported by the transport apparatus to the delivery mechanism.

In accordance with the transport apparatus as described above, productivity can be considerably improved because the articles can be smoothly transported at a higher transport speed than a conventional configuration while maintaining a predetermined orientation.

BEST MODE FOR CARRYING OUT THE INVENTION

A boxing apparatus 1 according to an embodiment of the present invention is described below with reference to FIGS. 1 to 6A and 6B.

Overall Configuration of Boxing Apparatus 1

Figure 1:
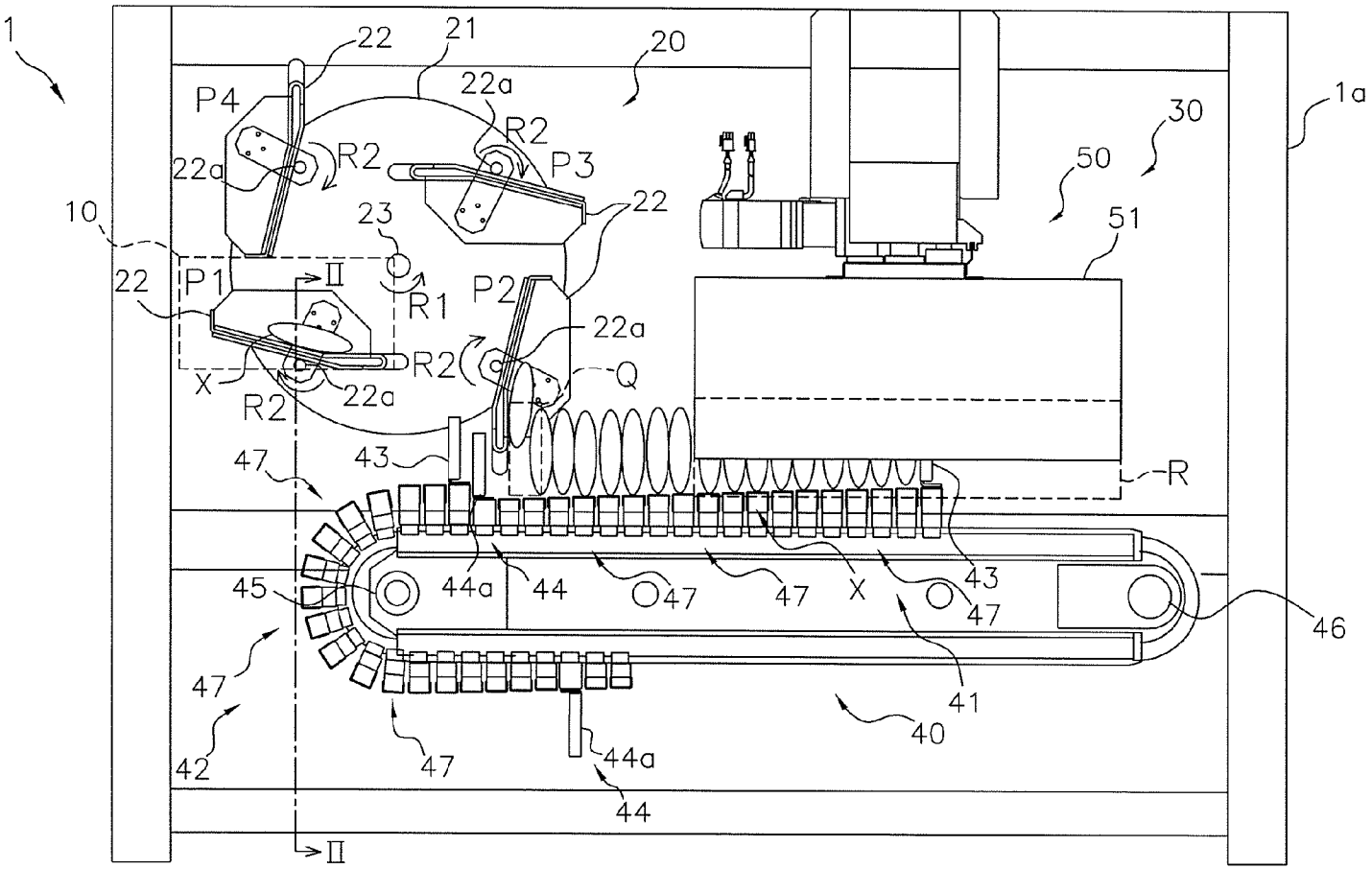
FIG. 1 is a side view showing the internal configuration of the boxing apparatus according to an embodiment of the present invention.
Figure 2:
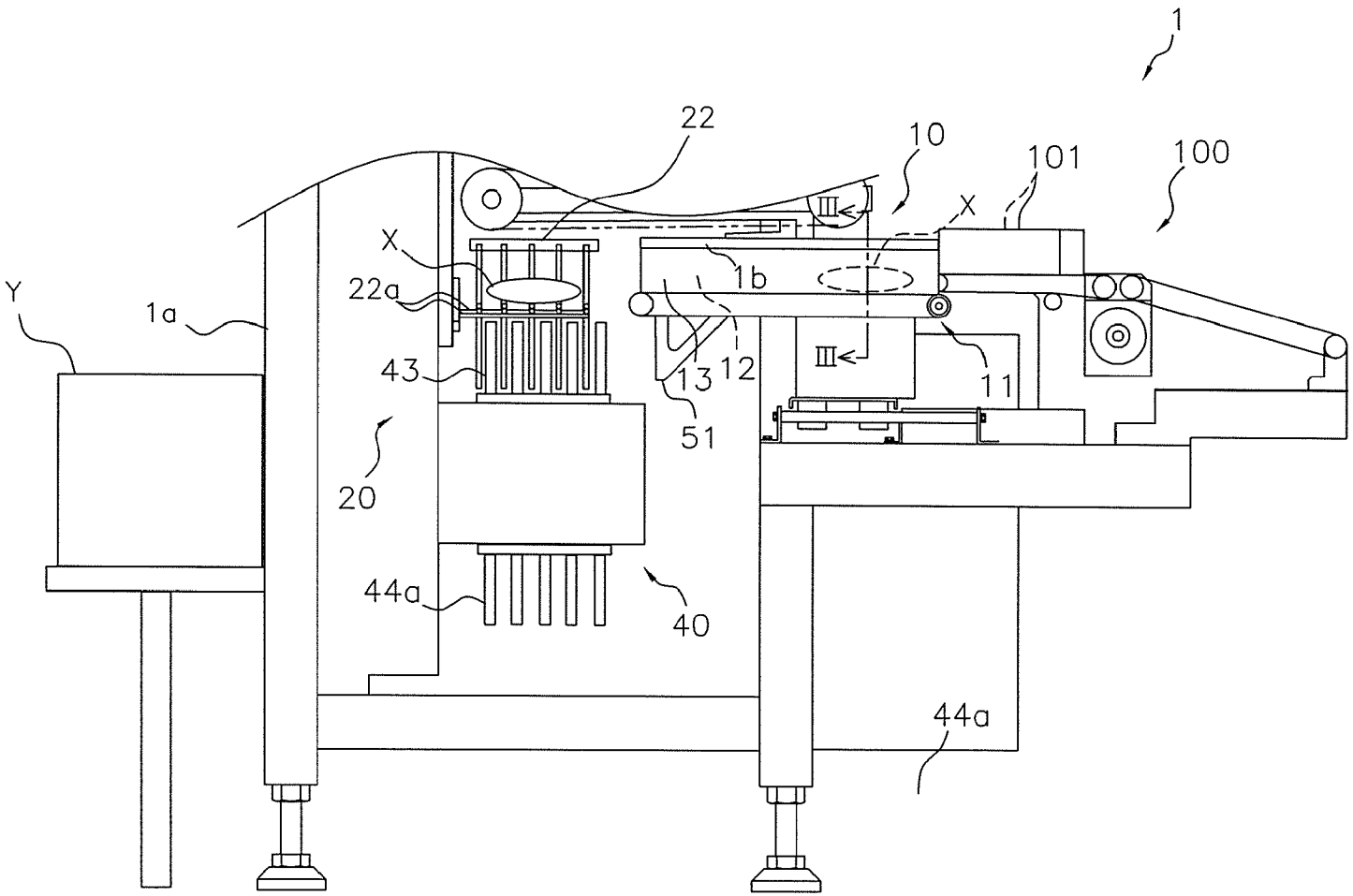
FIG. 2 is a cross-sectional view along the line II-II of FIG. 1.

The boxing apparatus 1 according to embodiments of the present invention is configured and arranged to transport and box a product X, which is a bag (article) containing snacks (see FIG. 6A) Z, into a cardboard box (predetermined box) Y, as shown in FIGS. 1 and 2. The boxing apparatus 1 is provided with a transport apparatus 10, a delivery mechanism 20, and a boxing mechanism (packing mechanism) 30.

Figure 3:
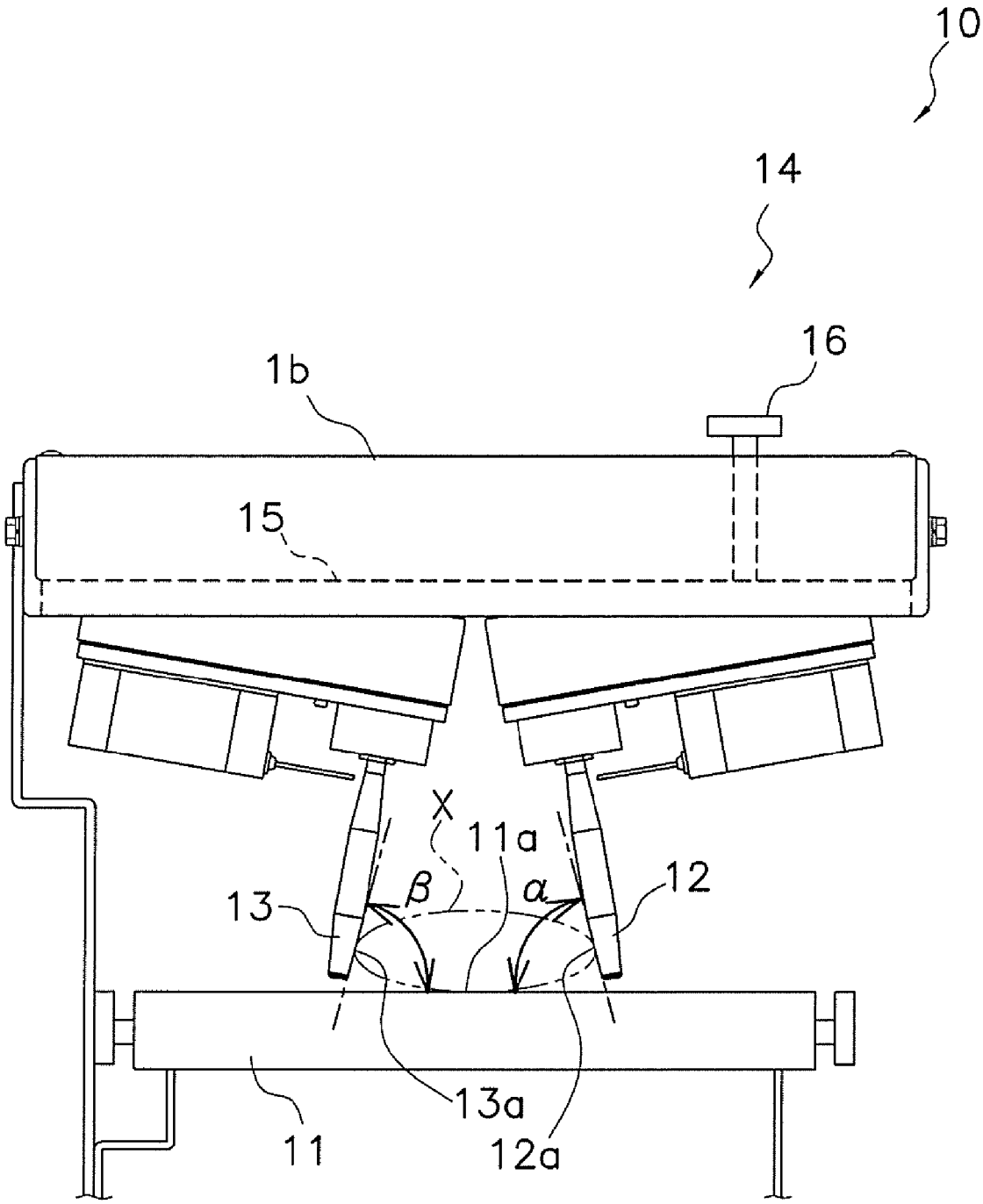
FIG. 3 is a cross-sectional view along the line III-III of FIG. 2.

Here, the product X is a square-shaped bag formed from a flexible material, and the thickness at the two end parts in the direction orthogonal to the predetermined transport direction (see transport direction A1 of FIG. 4) is less than the thickness of the center portion, as shown in FIG. 3 and other drawings.

Configuration of Transport Apparatus 10

The transport apparatus 10 is disposed on the most upstream side in the boxing apparatus 1, and sequentially transports each of the products X transported from an upstream conveyor 100 along the transport direction A1 (see FIG. 4) toward the downstream side, as shown in FIG. 2. The transport apparatus 10 has an intake conveyor 11 (first transport part), a pair of side conveyors (transport sections) 12, 13, and an adjustment mechanism 14. The side conveyors 12, 13 together form a second transport part in this embodiment.

The intake conveyor 11 is disposed on the most upstream side in the boxing apparatus 1, and transports the products X transported from the upstream conveyor 100 along the transport direction A1 toward the downstream side. The upper surface of the intake conveyor 11 is a transport surface 11*a*, and the products X are supported from below by the transport surface 11*a*.

Figure 4:
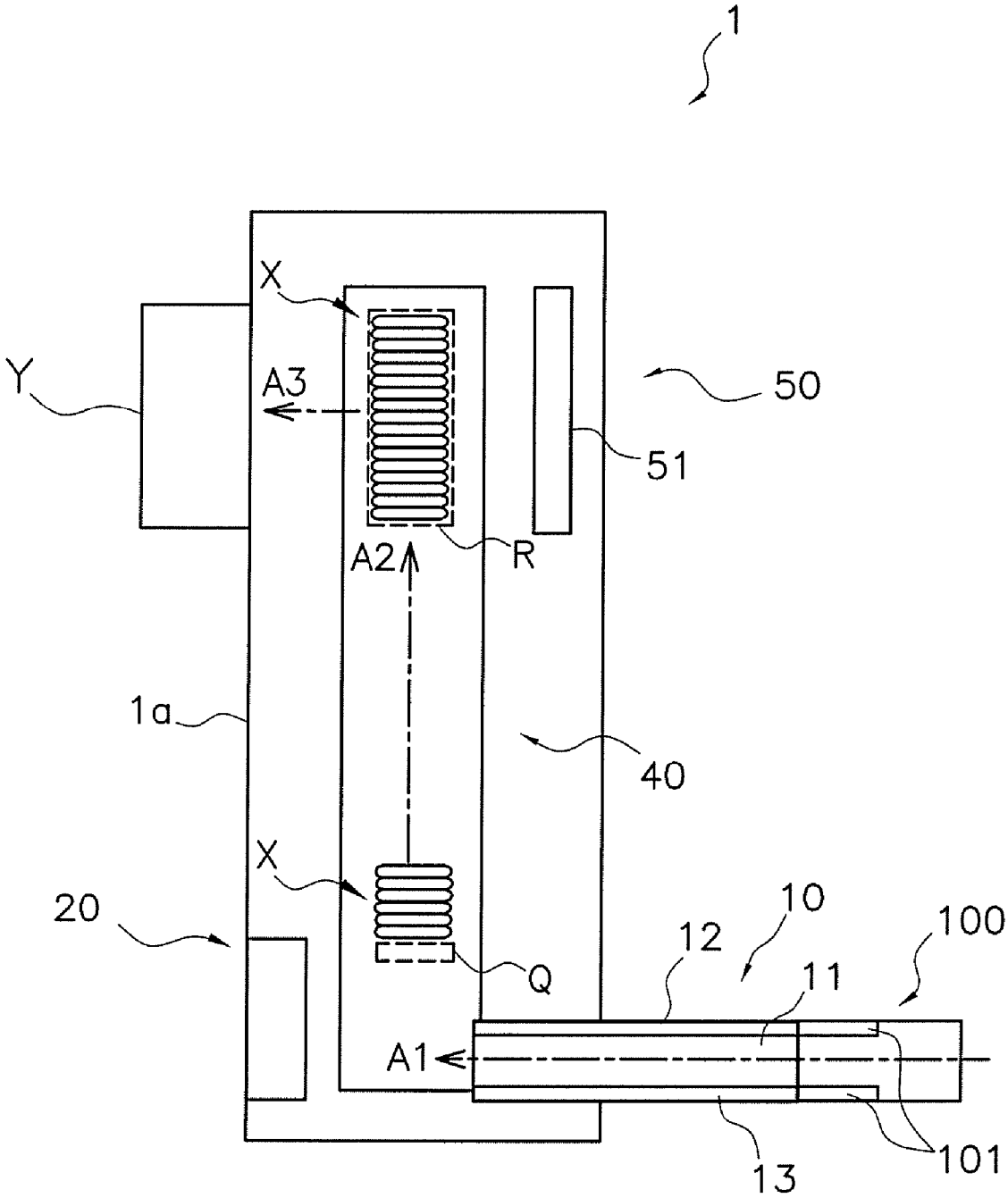
FIG. 4 is a schematic diagram showing the transport route of products in the boxing apparatus.

Here, as shown in FIG. 4, the conveyor 100 has guides 101 on the two ends along the transport direction A1. The transport speed of the conveyor 100 is set so as to be less than the transport speed of the intake conveyor 11. Also, the transport surface of the upstream conveyor 100 has a lower frictional resistance than the transport surface of the intake conveyor 11, and the products X can be transported while sliding somewhat on the surface of the upstream conveyor 100. For this reason, the conveyor 100 can deliver the products X to the downstream transport apparatus 10 while aligning the products X in a predetermined orientation by keeping the products X in contact with the guides 101 during transport.

The pair of side conveyors 12, 13 is disposed above the intake conveyor 11 substantially in an upside-down-V-shape when viewed from the upstream side toward the downstream side of the transport direction A1 of the products X, as shown in FIG. 3. In other words, the transport surfaces 12*a*, 13*a* where the products X is in contact with the side conveyors 12, 13 are facing obliquely downward, so as to exert a downward force on a portion of the upper surface of the products X during transport. The pair of side conveyors 12, 13 is set in such a way that each of the angles $\alpha$, $\beta$ formed by the transport surface 11*a* of the intake conveyor 11 and the transport surfaces 12*a*, 13*a* of the pair of side conveyors 12, 13 is approximately 80°.

The side conveyors 12, 13 transport the products X downstream along the transport direction A1 at a predetermined speed while the products X are kept in contact with the side conveyors 12, 13 at the two ends of each of the products X in the direction orthogonal to the transport direction A1 of the products X. In this situation, the transport speed of the pair of side conveyors 12, 13 is set to be approximately 5 m/min greater than the transport speed of the intake conveyor 11.

In this manner, the displacement of the products X in the vertically upward direction (up direction) and the direction parallel (lateral direction) to the transport surface of the intake conveyor 11 during transport can be effectively reduced by disposing the pair of side conveyors 12, 13 in such a way that the angles α, β are approximately 80°.

The intake conveyor 11 thereby transports the products X along the transport direction A1 while supporting the lower surface of the products X, and at the same time, the pair of side conveyors 12, 13 transports the products X along the transport direction A1 while making substantially symmetrical contact from diagonally above with the two ends of the transported products X. Accordingly, the products X (see FIG. 3) in which the end portions of the bag are thinner than the center portion can be transported while being pressed from diagonally above by the pair of side conveyors 12, 13.

Since the transport speed of the pair of side conveyors 12, 13 is greater than that of the intake conveyor 11 as described above, the products X can be pressed to the transport surface 11*a* of the intake conveyor 11 with greater force than the case in which the pair of side conveyors 12, 13 and the intake conveyor 11 transport the products X at a uniform speed. It is thereby possible to effectively reduce phenomena in which the products X spin in the direction parallel to the transport surface 11*a*, i.e., the lateral direction on the transport surface 11*a* of the intake conveyor 11, and in which the products X stand erect in substantially the upwardly vertical direction, i.e., the up direction.

Among products X, there are also those that are transported from the upstream conveyor 100 in a state slightly rotated from the desired orientation in the lateral direction, i.e., parallel to the transport surface 11*a*. In such a case, one of the end portions of the two ends of the products X makes earlier contact with the transport surface 12*a* of the side conveyor 12 or the transport surface 13*a* of the side conveyor 13. Therefore, a force operates so as to move the products X to the center of the transport surface 11*a* of the intake conveyor 11. The transport apparatus 10 can thereby transport the products X downstream while returning the products X to a predetermined transport orientation even if the products X are transported from the upstream side in a state slightly rotated from the desired orientation.

Figure 6A:
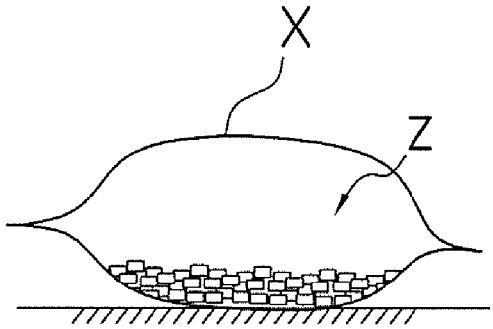
FIG. 6A is a cross-sectional view of a product among the products included in FIG. 1, showing the case in which snacks as contents are uniformly disposed in a bag.
Figure 6B:
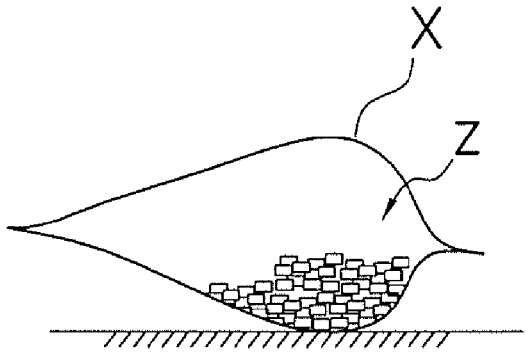
FIG. 6B is a cross-sectional view of a product among the products included in FIG. 1, showing the case in which distribution of snacks as contents therein is unbalanced.

Furthermore, for the case in which distribution of snacks Z as the contents of the products X have become unbalanced inside the bag as shown in FIG. 6B, there is an effect that the products X can be transported while approaching the uniform state shown in FIG. 6A by leveling out the snacks Z inside the bag as a result of the pair of side conveyors 12, 13 making contact with the products X during transport.

The adjustment mechanism 14 is disposed above the transport apparatus 10, as shown in FIG. 3, and has a slide rail 15 and a positioning stopper 16. The adjustment mechanism 14 adjusts the mounting position of the pair of side conveyors 12, 13 in the direction orthogonal to the transport direction A1.

The slide rail 15 is secured to a frame 1*b* positioned above the pair of side conveyors 12, 13, and movably supports the pair of side conveyors 12, 13 in the direction orthogonal to the transport direction A1.

The positioning stopper 16 is disposed so as to pass through the frame 1*b* above the slide rail 15, and the pair of side conveyors 12, 13 supported by the slide rail 15 is secured in an arbitrary position in the direction orthogonal to the transport direction A1.

The mounting position of the pair of side conveyors 12, 13 can thereby be adjusted in the transport apparatus 10 in accordance with the size of the products X to be transported.

In this manner, the movement of the products X is accelerated by the intake conveyor 11 and the pair of side conveyors 12, 13, which are in contact with the products X from three directions. Therefore, the products X can be transported with considerably greater acceleration than the case in which the products X are transported while in contact from only a single direction as in transport via a conventional conveyor, for example. For this reason, the transport distance required for the products X to reach a predetermined speed can be reduced in comparison with the case in which contact is made with the products X from a single direction to transport the products X.

Configuration of Delivery Mechanism 20

The delivery mechanism 20 is disposed downstream from the transport apparatus 10, receives the products X transported downstream along the transport direction A1 from the upstream transport apparatus 10, and sequentially aligns the bags in an erect orientation in a predetermined position Q. The delivery mechanism 20 has a support plate 21 and four delivery trays 22.

The support plate 21 is mounted on the side surface part of a main casing 1*a* so as to substantially face the transport direction A1 on the downstream side of the transport apparatus 10, as shown in FIGS. 1 and 4. The circular support plate 21 is rotatably supported by a rotating shaft 23 disposed in the center part.

Four delivery trays 22 are each circularly disposed on the side surface part of the support plate 21 downstream of the transport apparatus 10, and each has a pectinate placement surface. The delivery trays 22 each have a rotating shaft and are each rotatably mounted on the support plate 21.

The operation of the delivery trays 22 will be described in detail below.

First, a delivery tray 22 receives a product X transported from the upstream transport apparatus 10 in a substantially horizontal state in the position P1 shown in FIG. 1. At this point, the received product X is held in a state secured to the placement surface of the delivery tray 22 with the aid of a chucking apparatus (not shown).

Next, the support plate 21 is rotated approximately 90° in a rotation direction R1 about the rotating shaft 23. During this interval, the delivery tray 22 is rotated approximately 90° in a rotation direction R2 so that the product X assumes an erect orientation about a rotating shaft 22*a*, and is moved to the position P2 shown in FIG. 1. The product X is transported in an erect orientation to a predetermined downstream position Q. At this point, a bucket among buckets 41, 42 (described in detail in a later paragraph) is disposed in the predetermined position Q and the product X is received in the unchanged erect orientation.

The delivery tray 22 rotates approximately 90° about the rotating shaft 22*a* in the direction of the rotational direction R2 while the support plate 21 rotates approximately 90° in the rotational direction R1 about the rotating shaft 23 and the delivery tray 22 moves from the position P2 shown in FIG. 1 to the position P3 shown in FIG. 1. In a similar manner, the delivery tray 22 moves from position P3 to position P4. The delivery tray 22 moves in a similar fashion from the position P4 to the position P1, and again receives the product X transported from the upstream side in a substantially horizontal state.

Such operation is sequentially carried out by four delivery trays 22 disposed on the side surface part of the support plate 21, whereby the products X transported from the upstream transport apparatus 10 are transported in an erect orientation to the predetermined downstream position Q.

Configuration of Boxing Mechanism 30

The boxing mechanism 30 is disposed downstream of the delivery mechanism 20, and has a transport mechanism 40 and a discharge apparatus 50, as shown in FIG. 1. Along the transport direction A2 (see FIG. 4), the boxing mechanism 30 transports a predetermined number of the products X that have been delivered in an erect orientation at the predetermined position Q from the upstream delivery mechanism 20 while maintaining an erect orientation until the discharge position R. Also, when the predetermined number of products X are transported to the discharge position R as described above, the boxing mechanism 30 discharges the products X in a collected state in a cardboard box Y (see FIG. 4) that is set on the side surface of the discharge position R. A predetermined number of products X are thereby sequentially boxed.

Configuration of Transport Mechanism 40

Figure 5:
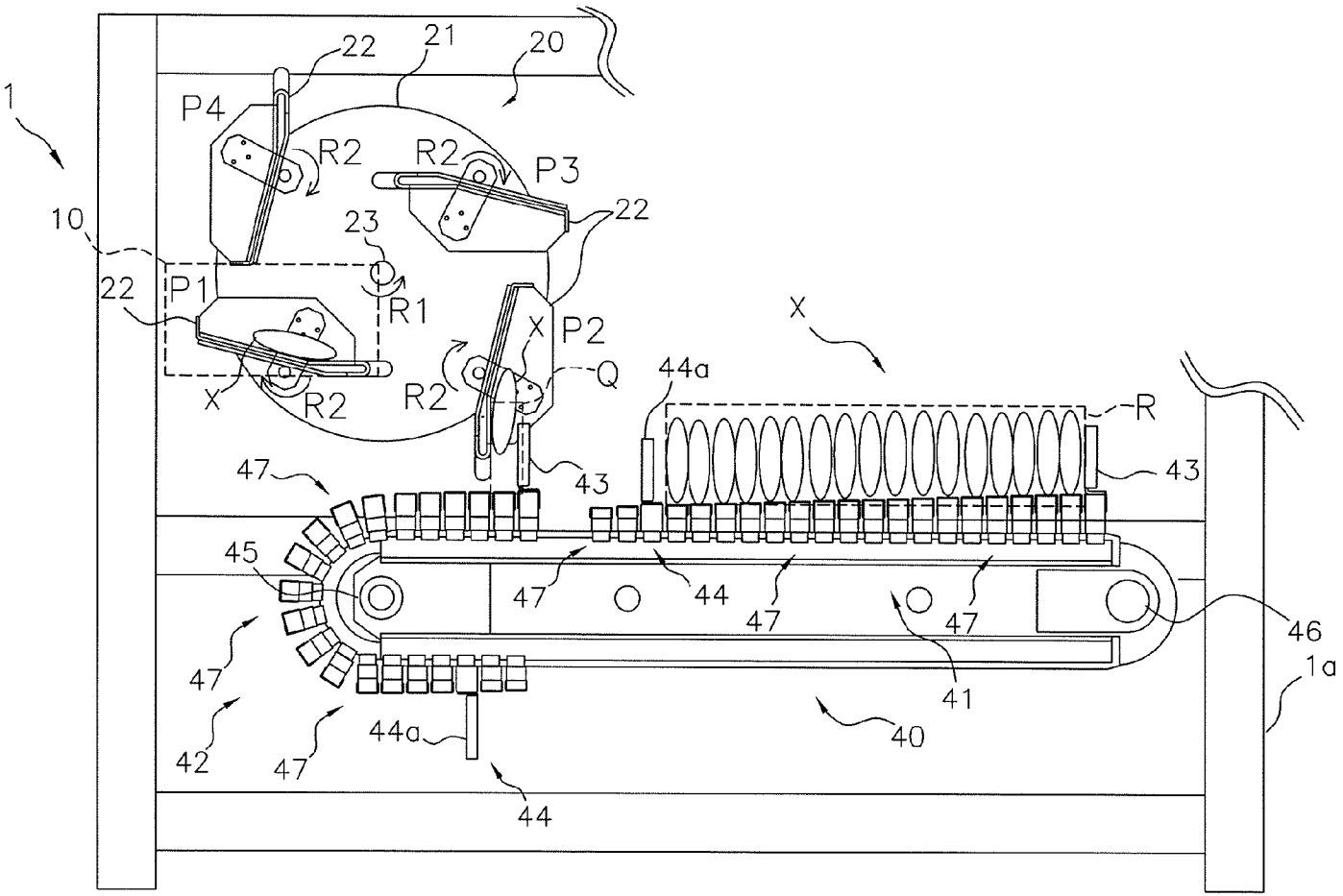
FIG. 5 is a view showing the transport route of the products included in FIG. 1.

The transport mechanism 40 has buckets 41, 42 and holding members 44, as shown in FIGS. 1 and 5, and sequentially receives the products X transported in an erect orientation from the upstream delivery mechanism 20 to the predetermined position Q and transports the product in sets of a predetermined number to the downstream discharge position R.

The buckets 41, 42 each travel independently between a pair of rotating shafts 45, 46 that is disposed one each on the upstream side and the downstream side of the transport mechanism 40, as shown in FIG. 1. Due to this traveling, the buckets 41, 42 transport the products X from the predetermined upstream position Q to the downstream discharge position R. The buckets 41, 42 are configured in combination with each of the plurality of bottom plates 47. In the buckets 41, 42, a partitioning plate 43 is provided to each of the bottom plates 47 of the upstream end portion in order to hold the products X in an erect orientation.

The holding members 44 are disposed so as to cover each of the downstream bottom plates 47 in the buckets 41, 42, as shown in FIGS. 1 and 5, and back plates 44*a* are provided for holding the products X in an erect orientation. Also, the holding members 44 can each be made to travel independently from the buckets 41, 42. Furthermore, the height of each of the holding members 44 can be modified. Accordingly, the downstream bottom plates 47 in the buckets 41, 42 can each be partially overtaken, i.e., overlapped.

The space between each of the back plates 44*a* and the partition plates 43 can thereby be modified in the buckets 41, 42. Accordingly, the predetermined number of products X to be transported in a single batch can be suitably modified in each of the buckets 41, 42.

The partitioning plates 43 and back plates 44*a*, and the mounting surface of the four delivery trays 22 are each formed in alternately pectinated shapes, and are designed so as to be capable of passing through each other, as shown in FIG. 2.

Here, the method for transporting the products X in the buckets 41, 42 will be described in greater detail below with reference to FIGS. 1 and 5 using the bucket 41 as an example.

When a products X are transported from an upstream delivery tray 22, the bucket 41 disposed downstream from the delivery tray 22 can receive the products X held in an unchanged erect orientation, as shown in FIG. 1, by moving downstream by a predetermined interval. When the products X delivered from upstream reaches a predetermined number in the bucket 41, the products X are transported along the transport direction A2 in an unchanged erect orientation to the downstream discharge position R, as shown in FIG. 5. At this point, the bucket 42 waiting upstream in the transport direction A2 of the bucket 41 rapidly moves downstream, as shown in FIG. 1, and the products X are sequentially received in an erect orientation from the delivery trays 22 in the same manner as the bucket 41.

The plurality of bottom plates 47 slopes at a predetermined angle from the upstream side toward the downstream side in the buckets 41, 42, as shown in FIG. 1, and is disposed so that the downstream bottom plates 47 are higher when the products X are transported. Accordingly, the downstream bottom plates 47 of the bucket 42 are designed to be capable of superimposing on the upstream bottom plates 47 of the bucket 41 in a partially overlapping state.

The bucket 42 can thereby wait in a position nearer to the predetermined position Q. Therefore, after the bucket 41 moves to the downstream discharge position R, the bucket 41 rapidly moves downstream in the transport direction A2 and the products X can be received from the upstream side. The bucket 41 is also designed to be capable of partially superimposing on the upstream bottom plates 47 of the bucket 42 in the same manner.

Next, the bucket 41 moves in the transport direction A2 on the transport mechanism 40 when the products X disposed in an erect orientation in the bucket 41 are discharged to a cardboard box Y (see FIG. 4) with the aid of the discharge apparatus 50 described in detail in a later paragraph. When the bucket 41 reaches to the end part of the downstream side of the transport mechanism 40, the bucket 41 goes around to the lower portion of the transport mechanism 40 and moves in the direction opposite from the transport direction A2, moves upstream in the transport direction A2 of the bucket 42 and waits. When the bucket 42 has received a predetermined number of the products X from the upstream side and has moved to the discharge position R, the bucket 41 rapidly moves downstream in the transport direction A2 and sequentially receives a predetermined number of the products X from the upstream side in the same manner as described above.

The products X are thereby transported in an unchanged erect orientation to the downstream discharge position R.

Configuration of Discharge Apparatus 50

The discharge apparatus 50 is disposed in the vicinity of the discharge position R on the downstream side of the transport mechanism 40, as shown in FIGS. 1 and 4, and has a press-out plate 51 driven by a drive motor disposed in the upper part of the main casing 1*a*.

The press-out plate 51 is disposed in a lateral area of the transport mechanism 40 in the downstream side of the transport mechanism 40. The press-out plate 51 presses out products X that are sequentially transported from the upstream side by the buckets 41, 42, in the transport direction A3 (see FIG. 4) substantially orthogonal to the transport direction A2

(see FIG. 4). The products X are sequentially transported and boxed in a cardboard box Y disposed in the lateral area of the boxing apparatus 1.

Accordingly, the productivity of the boxing apparatus 1 is considerably improved because the products X can be smoothly transported by the transport apparatus 10 to the delivery mechanism 20.

Characteristics of Boxing Apparatus 1

(1) The transport apparatus 10 provided with the boxing apparatus 1 of the present embodiment has an intake conveyor 11 for transporting products X, and a pair of side conveyors 12, 13 disposed above the intake conveyor, as shown in FIG. 3. The pair of the side conveyors 12, 13 makes contact with two side parts, respectively, of the products X riding on the transport surface 11*a* of the intake conveyor 11 in the direction orthogonal to the transport direction A1, and transports the products X in the transport direction A1.

Ordinarily, instant noodles and other food products are transported through each step in a bagged state in a bag formed from a flexible material. In such a situation, there are cases in which the bags are transferred between conveyors having different transport speeds and cases in which the bags spin or stand erect in a wheelie state on the transport surface of the conveyor when the bags are delivered to the next downstream step. A substantially vertical guide is conventionally provided to the two sides of the conveyor in response to such transport problems.

However, since displacement in the upward direction of the transported bags cannot be reduced with such a guide, the bags assume an erect state and are liable to be unable to be transported in a predetermined orientation.

In view of the above, the products X are transported while a downward force is applied to a part of the upper surface of the products X by the pair of side conveyors 12, 13 in the transport apparatus 10 of the present embodiment. Specifically, the side conveyors 12, 13 are disposed facing each other in such a way that the angles α, β that the transport surfaces 12*a*, 13*a* of the pair of side conveyors 12, 13 form with the transport surface 11*a* of the intake conveyor 11 are acute angles (in this case, approximately 80°).

The intake conveyor 11 thereby supports the lower surface of the products X and carries out transport operation along the transport direction A1, and the pair of side conveyors 12, 13 makes contact from diagonal upside in relation to the two end parts of the width direction of the products X and transports the products along the transport direction A1. Accordingly, an effect is brought about in which the pair of side conveyors 12, 13 presses the products X in a diagonal downward direction, and the products X are transported along the transport direction A1 in a state in which displacement in the lateral direction is reduced and displacement in the upward direction is also reduced.

As a result, the products X can be smoothly transported at a greater speed than a conventional configuration while maintaining a predetermined orientation, and productivity is considerably improved.

Disruption of the transport interval of the products X can be reduced in comparison with the case in which a guide (a member that does not have a transport function) is provided to the two sides of the conveyor for supporting the lower surface of the products. In the case that a guide is provided, the transport speed of the products X is reduced due to frictional resistance between the guide and the products X when the products X are transported, and the transport interval of the products X is highly likely to be disrupted. In the case of the side conveyors 12, 13, disruption of the transport interval of the products X substantially does not occur because the conveyors as such transport the products X.

Because of the intake conveyor 11 and the pair of side conveyors 12 and 13 that make contact with the products X from three directions and accelerate the products X as stated above, the products X can be transported with considerable acceleration in comparison with transport with, e.g., an ordinary conveyor in which the products X are transported while contact is made from a single direction. For this reason, an effect is also achieved in which the transport distance required for the products X to reach a predetermined speed can be reduced in comparison with the case in which contact is made with the products X from a single direction to transport the products X.

(2) Products X, which are bags formed from a flexible material and contain snacks Z, are transported by the transport apparatus 10 provided with a boxing apparatus 1 of the present embodiment.

Ordinarily, phenomena in which the bags stand erect or rotate during transport occurs with marked frequency when the bags formed from a flexible material (hereinafter referred to as bags) are transported with a conveyor or the like, and there are cases in which the bags cannot be transported while being held in a predetermined orientation.

In contrast, the transport apparatus 10 of the present embodiment can transport the products X more smoothly than a conventional configuration while the products are kept in a predetermined orientation because the intake conveyor 11 supports the lower surface of the products X and transports the products X along the transport direction A1, and the pair of side conveyors 12, 13 exerts a downward force on a portion of the upper surface of the products X while transporting the products X, as described above.

(3) In the transport apparatus 10 provided with a boxing apparatus 1 of the present embodiment, the pair of side conveyors 12, 13 have transport surfaces 12*a*, 13*a* that face diagonally downward at the same slope angle, as shown in FIG. 3.

Displacement of the products X in the lateral and upward directions transported by the intake conveyor 11 and the pair of side conveyors 12, 13 is substantially eliminated.

(4) In the transport apparatus 10 provided with a boxing apparatus 1 of the present embodiment, the thickness of the center portion and the end portion of the products X are different in the direction (width direction) orthogonal to the transport direction A1, as shown in FIG. 3. Among such products X, there are many that are obtained by merely filling the contents into a bag, and there are cases in which the bag readily deforms and the contents become concentrated in a single location inside the bag (see FIG. 6B) when an external force is applied. A bag such as that described above may wheelie or spin when the bag is transported in such a state by the intake conveyor 11 alone.

In contrast, in the transport apparatus 10 provided with a boxing apparatus 1 of the present embodiment, the pair of side conveyors 12, 13 exerts a downward force in the vicinity of the two end portions of the products X where the thickness of the bag is low during transport of the products X. For this reason, wheelieing and spinning of the products X is reduced during transport.

(5) In the transport apparatus 10 provided with a boxing apparatus 1 of the present embodiment, the pair of side conveyors 12, 13 have a higher transport speed than the intake conveyor 11.

Accordingly, the products X are pressed to the transport surface 11*a* of the intake conveyor 11 by a stronger force in comparison with the case in which the pair of side conveyors 12, 13 and the intake conveyor 11 transport the products X at a uniform speed.

The phenomena in which the products X spin in the direction parallel to the transport surface 11*a* or stand erect in the vertically upward direction on the transport surface 11*a* of the intake conveyor 11 can thereby be effectively reduced.

Among the products X that sequentially flow downstream, there are those that are transported in a slightly rotated state in the direction parallel to the transport surface 11*a* in comparison with the desired orientation. In this case as well, one of the two end portions of the products X makes contact first with one of the transport surfaces 12*a*, 13*a* of the side conveyor 12 and the side conveyor 13, as long as the transport speed of the side conveyors 12, 13 is greater than the transport speed of the intake conveyor 11. A force will thereby be exerted that moves the products X to the center of the transport surface 11*a* of the intake conveyor 11. Therefore, the transport apparatus 10 can transport the products X to the downstream side while returning the products to a desired transport orientation even if the products X are transported from the upstream side in a state slightly rotated from the desired orientation.

(6) In the transport apparatus 10 provided with a boxing apparatus 1 of the present embodiment, the transport surfaces 12*a*, 13*a* of the pair of side conveyors 12, 13 are set such that the angles α, β formed by the transport surface 11*a* of the intake conveyor 11 and the transport surfaces 12*a*, 13*a* of the pair of side conveyors 12, 13 are each approximately 80°, as shown in FIG. 3.

Displacement of the products X in the lateral and upward directions can thereby be effectively reduced.

(7) In the transport apparatus 10 provided with a boxing apparatus 1 of the present embodiment, an adjustment mechanism 14 is provided for adjusting the mounting position of the pair of side conveyors 12, 13 in the direction orthogonal to the transport direction A1, as shown in FIG. 3.

The mounting position of the pair of side conveyors 12, 13 can thereby be adjusted in accordance with the size of the products X to be transported.

OTHER EMBODIMENTS

An embodiment of the present invention was described above, however, the present invention is not limited to the embodiment described above, and various modifications can be made in a range that does not depart from the spirit of the invention.

Embodiment (A)

In the embodiment described above, the angles α, β formed by the transport surfaces 12*a*, 13*a* of the pair of side conveyors 12, 13 and the transport surface 11*a* of the intake conveyor 11 are each set to approximately 80° in the transport apparatus 10.

However, the present invention is not limited to this configuration.

For example, the angles α, β may be set so that only one of the angles is acute, in accordance with the shape of the bag to be transported. In this case as well, phenomena in which the products X as the bags stand erect in a wheelie state or spin can be reduced because one of the side conveyors 12, 13 presses the products X to the transport surface 11*a* of the intake conveyor 11.

Embodiment (B)

In the embodiment described above, the transport surfaces 12*a*, 13*a* of the pair of side conveyors 12, 13 have angles α, β of approximately 80° in relation to the transport surface 11*a* of the intake conveyor 11 in the transport apparatus 10.

However, the present invention is not limited to this configuration.

For example, the mounting angles of the side conveyors may be set so that the angles α, β are 85° or more and 95° or less in accordance with the shape of the products X as bags to be transported and the setting of the transport speed of the pair of side conveyors 12, 13. However, one of the angles α, β must be an acute angle (0° to 90°) because a downward force must be exerted on the products X from one of the side conveyors 12, 13.

In this case as well, the same effect as the transport apparatus 10 according to the embodiment described above can be obtained.

Embodiment (C)

In the embodiment described above, the products X transported in the transport apparatus 10 have a thickness that is different in the center portion and at the end portions in the width direction orthogonal to the transport direction A1.

However, the present invention is not limited to this configuration.

For example, the articles to be transported in the transport apparatus 10 may have a substantially uniform thickness in the center portion and the end portions in the width direction. The transport apparatus 10 can obtain a number of effects according to the present invention even in the case of such products.

Embodiment (D)

In the embodiment described above, the pair of side conveyors 12, 13 has a greater transport speed than the intake conveyor 11.

However, the present invention is not limited to this configuration.

For example, the transport speed of the pair of side conveyors 12, 13 and the intake conveyor 11 may be at a uniform speed as long as the products X can be smoothly transported.

However, in this case, the force for pressing the products X to the transport surface of the intake conveyor 11 may be reduced in comparison with the case in which the transport speed of the pair of side conveyors 12, 13 is greater than the transport speed of the intake conveyor 11. Therefore, it is preferred that the transport speed of the pair of side conveyors 12, 13 be greater than the transport speed of the intake conveyor 11 as in the embodiment described above.

Embodiment (E)

In the embodiment described above, an adjustment mechanism 14 is present, but when the size of the products X as the transport object is limited, the adjustment mechanism 14 can be omitted. In this case, the transport apparatus 10 can be simplified and the cost of the apparatus can be reduced.

The adjustment mechanism 14 may be provided with a function that allows the angles α, β formed between the transport surfaces 12*a*, 13*a* of the pair of side conveyors 12, 13 and the transport surface 11*a* of the intake conveyor 11 to be adjusted. In this case, an operator can finely adjust the angles α, β in the transport apparatus 10 in accordance with the transport state of the products X.

Embodiment (F)

In the embodiment described above, the transport apparatus 10 according to the present invention is adopted in a boxing apparatus 1.

However, the present invention is not limited to this configuration.

For example, the transport apparatus 10 may be provided to another industrial machine.

Embodiment (G)

In the embodiment described above, a pair of side conveyors 12, 13 is used in the transport apparatus 10.

However, the present invention is not limited to this configuration.

For example, a pair of transport roller groups may be used in place of the pair of side conveyors 12, 13 as long as the products X can be transported without a problem. In this case as well, the same effects as those of the transport apparatus 10 according to the embodiment described above can be obtained.

Embodiment (H)

In the embodiment described above, the pair of side conveyors 12, 13 has a transport speed that is approximately 5 m/min greater than that of the intake conveyor 11.

However, the present invention is not limited to this configuration.

For example, it is preferred that the degree to which the transport speed of the pair of side conveyors 12, 13 is made faster than the intake conveyor 11 be suitably set in accordance with the size and weight of the products X to be transported.

Embodiment (I)

In the embodiment described above, the products X as bags formed from a flexible material are the transport objects in the transport apparatus 10.

However, the present invention is not limited to this configuration.

For example, products packaged in a container (box) made from paper may be transported in place of the products X in the transport apparatus 10 as long as the size allows transport.

Embodiment (J)

Figure 7:
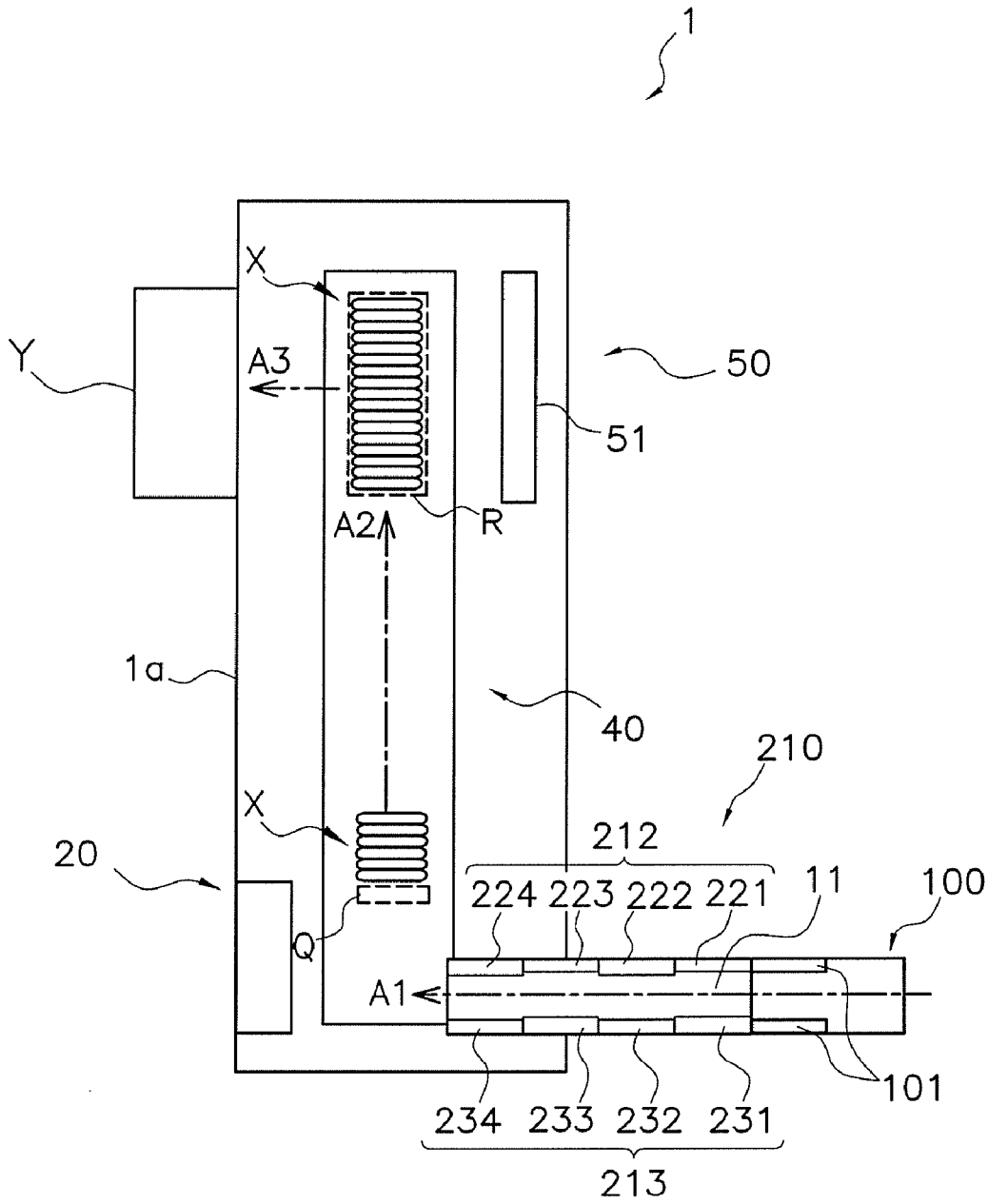
FIG. 7 is a schematic view corresponding to FIG. 4 of the transport apparatus according to other embodiments (J), (K).

In the embodiment described above, the length along the transport direction A1 of the side conveyors 12, 13 is the same as the length along the transport direction A1 of the intake conveyor 11, but it is preferred that side conveyors 212, 213 shown in FIGS. 7 and 8 be adopted in place of the side conveyors 12, 13 as long as there are no cost-related problems. In the particular case that it is envisioned that numerous products X in which distribution of the contents (snacks Z) is unbalanced in the bag will flow downstream in the manner shown in FIG. 6B, it is preferred that the side conveyors 212, 213 be used.

In the transport apparatus 210 shown in FIGS. 7 and 8, the pair of side conveyors 212, 213 is each divided into four units along the transport direction A1. In other words, aligned from the upstream side toward the downstream side are a pair of first right-side and left-side conveyors 221, 231, a pair of second right-side and left-side conveyors 222, 232, a pair of third right-side and left-side conveyors 223, 233, and a pair of fourth right-side and left-side conveyors 224, 234. The pair of side conveyors 212, 213, which is an assembly of the conveyors 221, 231, 222, 232, 223, 233, 224, and 234, have the same length as that along the transport direction A1 of the intake conveyor 11.

Figure 8A:
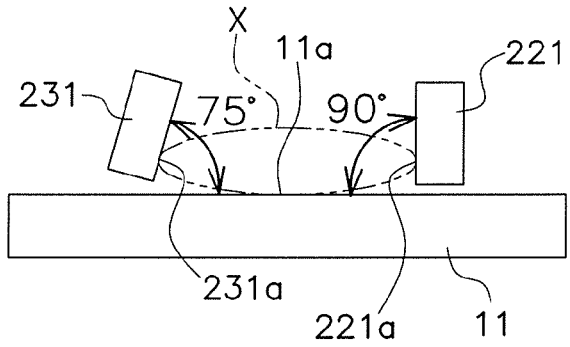
FIG. 8A is a diagram showing the slope of a pair of first transport surfaces of the transport apparatus according the embodiment (J).

The pair of first right-side and left-side conveyors 221, 231 makes contact from the side with the two end parts of the products X in the direction orthogonal to the transport direction A1, and transports the products X toward the downstream side as shown in FIG. 8A. The first right-side conveyor 221 has a first right-side transport surface 221*a* that makes contact with the products X and transports the products X. On the other hand, the first left-side conveyor 231 has a first left-side transport surface 231*a* that makes contact with the products X and transports the products X. The angle formed by the first right-side transport surface 221*a* and the transport surface 11*a* of the intake conveyor 11 is 90°. The angle formed by the first left-side transport surface 231*a* and the transport surface 11*a* of the intake conveyor 11 is 75°. Therefore, the pair of first right-side and left-side conveyors 221, 231 has the first left-side transport surface 231*a* that faces diagonally downward, and the first left-side transport surface 231*a* exerts a downward force on a portion of the upper surface of the products X.

Figure 8B:
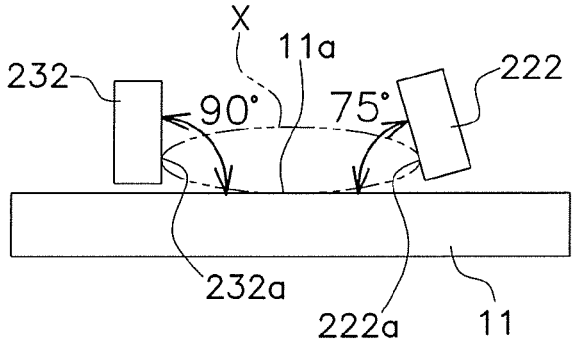
FIG. 8B is a diagram showing the slope of a pair of second transport surfaces of the transport apparatus according the embodiment (J).

The pair of second right-side and left-side conveyors 222, 232 makes contact from the side with the two end parts of the products X in the direction orthogonal to the transport direction A1, and transports the products X toward the downstream side as shown in FIG. 8B. The second right-side conveyor 222 has a second right-side transport surface 222*a* that makes contact with the products X and transports the products X. On the other hand, the second left-side conveyor 232 has a second left-side transport surface 232*a* that makes contact with the products X and transports the products X. The angle formed by the second right-side transport surface 222*a* and the transport surface 11*a* of the intake conveyor 11 is 75°. The angle formed by the second left-side transport surface 232*a* and the transport surface 11*a* of the intake conveyor 11 is 90°. Therefore, the pair of second right-side and left-side conveyors 222, 232 has the second right-side transport surface 222*a* that faces diagonally downward, and the second right-side transport surface 222*a* exerts a downward force on a portion of the upper surface of the products X.

Figure 8C:
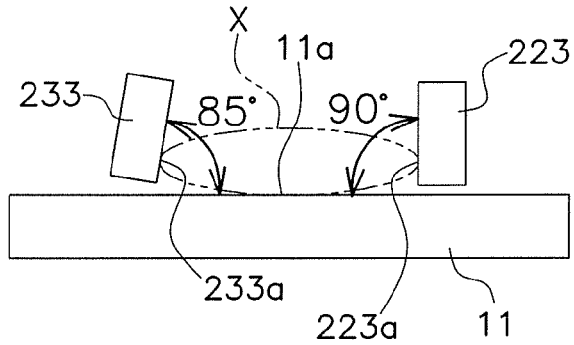
FIG. 8C is a diagram showing the slope of a pair of third transport surfaces of the transport apparatus according the embodiment (J).

The pair of third right-side and left-side conveyors 223, 233 makes contact from the side with the two end parts of the products X in the direction orthogonal to the transport direction A1, and transports the products X toward the downstream side that as shown in FIG. 8C. The third right-side conveyor 223 has a third right-side transport surface 223*a* that makes contact with the products X and transports the products X. On the other hand, the third left-side conveyor 233 has a third left-side transport surface 233*a* that makes contact with the products X and transports the products X. The angle formed by the third right-side transport surface 223*a* and the transport surface 11*a* of the intake conveyor 11 is 90°. The angle formed by the third left-side transport surface 233*a* and the transport surface 11*a* of the intake conveyor 11 is 85°. Therefore, the pair of third right-side and left-side conveyors 223, 233 has the third left-side transport surface 233*a* that faces diagonally downward, and the third left-side transport surface 233*a* exerts a downward force on a portion of the upper surface of the products X.

Figure 8D:
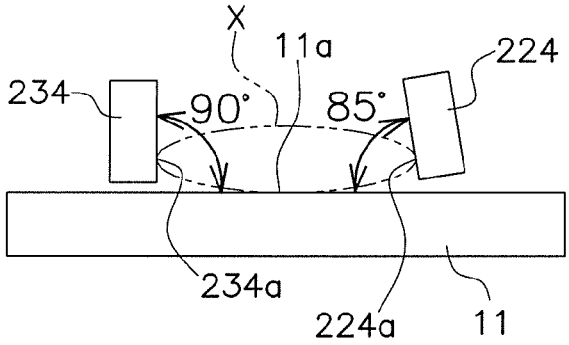
FIG. 8D is a diagram showing the slope of a pair of fourth transport surfaces of the transport apparatus according the embodiment (J).
Figure 9A:
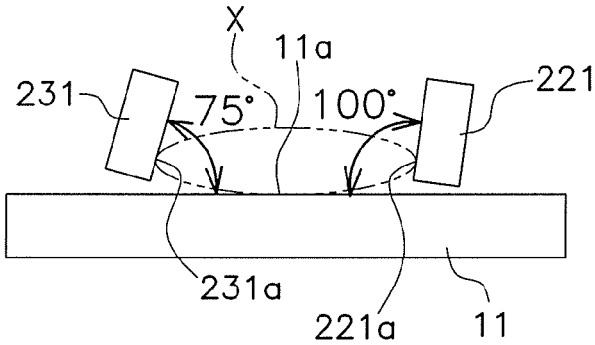
FIG. 9A is a diagram showing the slope of a pair of first transport surfaces of the transport apparatus according the embodiment (K).
Figure 9B:
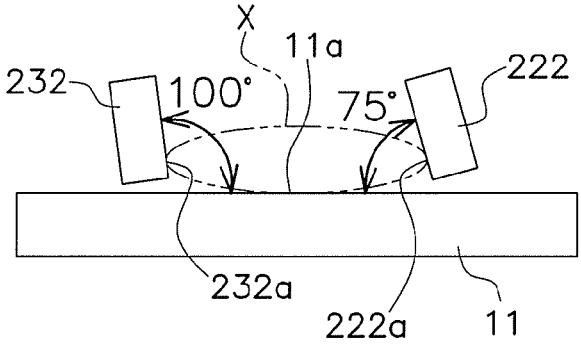
FIG. 9B is a diagram showing the slope of a pair of second transport surfaces of the transport apparatus according the embodiment (K).
Figure 9C:
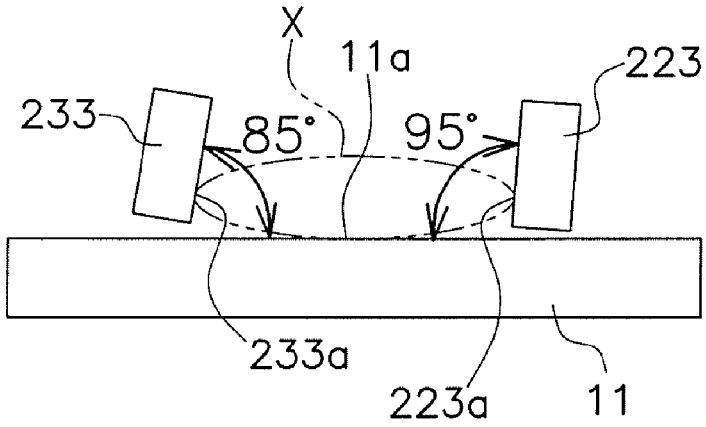
FIG. 9C is a diagram showing the slope of a pair of third transport surfaces of the transport apparatus according the embodiment (K).
Figure 9D:
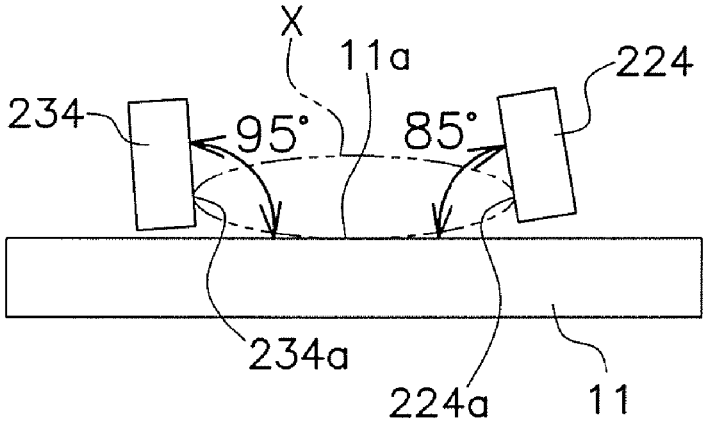
FIG. 9D is a diagram showing the slope of a pair of fourth transport surfaces of the transport apparatus according the embodiment (K).

The pair of fourth right-side and left-side conveyors 224, 234 makes contact from the side with the two end parts of the products X in the direction orthogonal to the transport direction A1, and transports the products X toward the downstream side as shown in FIG. 8D. The fourth right-side conveyor 224 has a fourth right-side transport surface 224*a* that makes contact with the products X and transports the products X. On the other hand, the fourth left-side conveyor 234 has a fourth left-side transport surface 234*a* that makes contact with the products X and transports the products X. The angle formed by the fourth right-side transport surface 224*a* and the transport surface 11*a* of the intake conveyor 11 is 85°. The angle formed by the fourth left-side transport surface 234*a* and the transport surface 11*a* of the intake conveyor 11 is 90°. Therefore, the pair of fourth right-side and left-side conveyors 224, 234 has the fourth right-side transport surface 224*a* that faces diagonally downward, and the fourth right-side transport surface 224*a* exerts a downward force on a portion of the upper surface of the products X.

As described above, in the transport apparatus 210, each of the pair of first right-side and left-side transport surfaces 221*a*, 231*a*, the pair of second right-side and left-side transport surfaces 222*a*, 232*a*, the pair of third right-side and left-side transport surfaces 223*a*, 233*a*, and the pair of fourth right-side and left-side transport surfaces 224*a*, 234*a* is set in a different orientation with respect to the transport surface 11*a* of the intake conveyor 11. Distribution of the contents of the products X, which are bags formed from a flexible material, may become unbalanced in the manner shown in FIG. 6B, and such unbalance is corrected during transport because of the varying direction of the force that the products X receive from the pair of side conveyors 212, 213 in each position in the transport direction A1.

Embodiment (K)

In the embodiment (J) described above, each of the angles formed by the first left-side transport surface 231*a*, the second right-side transport surface 222*a*, the third left-side transport surface 233*a*, and the fourth right-side transport surface 224*a* with the transport surface 11*a* of the intake conveyor 11 is an acute angle, and each of the angles formed by the first right-side transport surface 221*a*, the second left-side transport surface 232*a*, the third right-side transport surface 223*a*, and the fourth left-side transport surface 234*a* is 90° with the transport surface 11*a* of the intake conveyor 11, but it is preferred that the angles be suitably adjusted in accordance with the material of the products X and the type and specific gravity of the contents.

For example, the angle can be set in the manner shown in FIGS. 9A to 9D when it is desired that contents that have a large specific gravity and distribution thereof is unbalanced inside the products X be moved to the center by exerting a strong shaking force on the products X in the lateral direction orthogonal to the transport direction A1. In this case, the angles formed by each of the first right-side transport surface 221*a*, the second left-side transport surface 232*a*, the third right-side transport surface 223*a*, and the fourth left-side transport surface 234*a* with the transport surface 11*a* of the intake conveyor 11 is an obtuse angle. Specifically, the angles formed by each of the first right-side transport surface 221*a* and the second left-side transport surface 232*a* with the transport surface 11*a* of the intake conveyor 11 is set to 100°, and the angles formed by each of the third right-side transport surface 223*a* and the fourth left-side transport surface 234*a* with the transport surface 11*a* of the intake conveyor 11 is set to 95°.

In the embodiments (J) and (K), the sum of the angles formed between the transport surface 11*a* of the intake conveyor 11 and each of the first to fourth right-side transport surfaces 221*a*, 222*a*, 223*a*, and 224*a*, and the sum of the angles formed between the transport surface 11*a* of the intake conveyor 11 and each of the first to fourth left-side transport surfaces 231*a*, 232*a*, 233*a*, and 234*a* are equal. The force applied to the right side portion of the products X by the pair of side conveyors 212, 213 overall and the force applied to the left side portion of the products X by the pair of side conveyors 212, 213 overall are set in opposition by setting the angles in such a manner, and it is possible to reduce drawbacks such as displacement of the products X in the width direction (the lateral direction orthogonal to the transport direction A1) during transport of the products X while eliminating the unbalanced distribution of the contents of the products X.

Embodiment (L)

In the embodiment described above, an intake conveyor 11 and a pair of side conveyors 12, 13 were provided as conveyors having a transport function in the transport apparatus 10, but in addition to the conveyors, it is also possible to provide a top conveyor 314 (third transport part).

Figure 10:
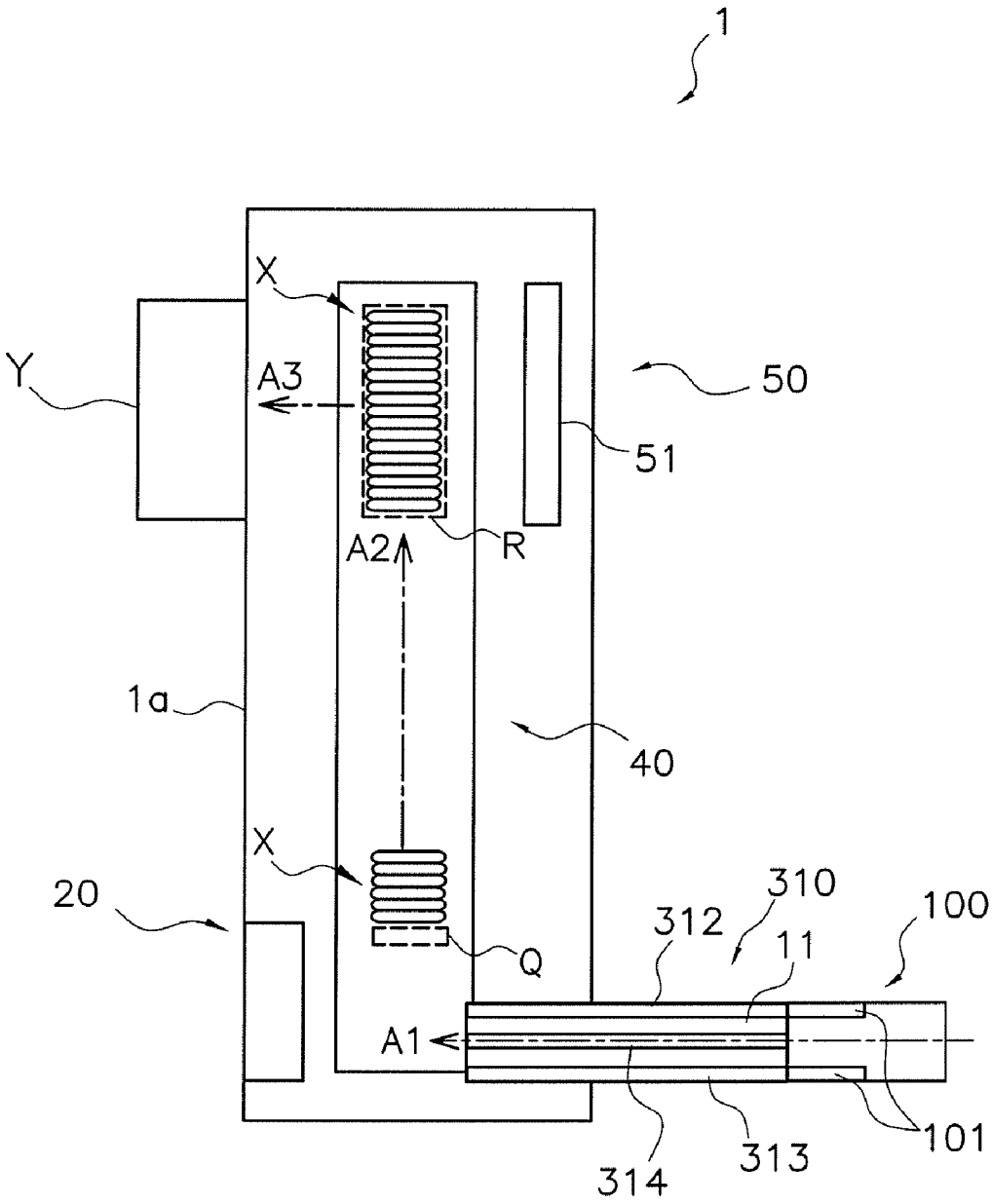
FIG. 10 is a schematic view corresponding to FIG. 4 of the transport apparatus according to other embodiment (L).
Figure 11:
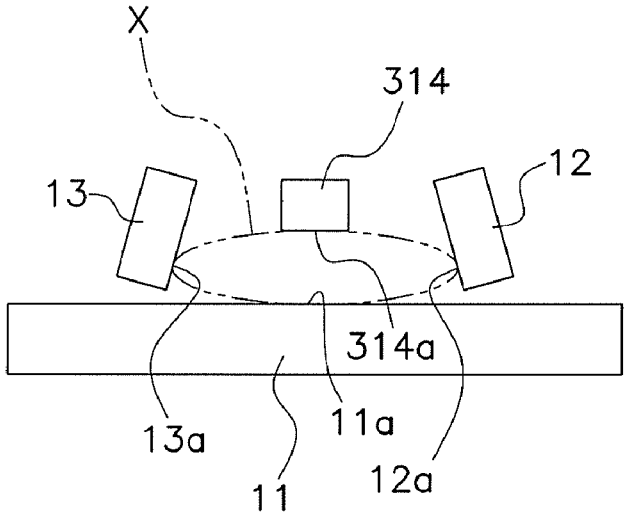
FIG. 11 is a diagram showing the arrangement of each transport surface of the transport apparatus according to the embodiment (L).

The top conveyor 314 has a transport surface 314*a* disposed between the transport surface 12*a* of the side conveyor 12 and the transport surface 13*a* of the side conveyor 13, as shown in FIGS. 10 and 11, and the products X are transported downstream along the transport direction A1 while the transport surface 314*a* exerts a downward force on the products X.

The wheelie phenomenon and the like of the products X can be reliably reduced even if the transport apparatus 310 to which such a top conveyor 314 has been added does not have an acute angle formed between the transport surface 11*a* of the intake conveyor 11 and the transport surfaces 12*a*, 13*a* of the side conveyors 12, 13.

Embodiment (M)

Figure 12:
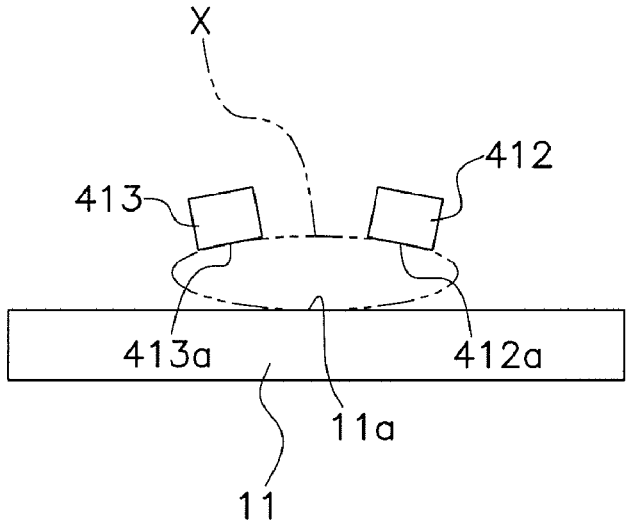
FIG. 12 is a diagram showing the arrangement of each transport surface of the transport apparatus according to the embodiment (M).

In the embodiment described above, a pair of side conveyors 12, 13 that make contact with the two side portions of the products X in the width direction is used in the transport apparatus 10, but instead it is also possible to use a pair of side conveyors 412, 413 shown in FIG. 12.

The side conveyor 412 has a first transport surface 412*a* that makes contact with a portion near one end of the products X in the width direction, and on the other hand, the side conveyor 413 has a second transport surface 413*a* that makes contact with a portion near the other end of the products X in the width direction. The transport surfaces 412*a*, 413*a* that are in contact with the products X on the side conveyors 412, 413 face diagonally downward and transport products X while exerting a downward force on a portion of the upper surface of the products X. The angles formed between the transport surface 11*a* of the intake conveyor 11 and the transport surfaces 412*a*, 413*a* of the pair of side conveyors 412, 413 are each approximately 10°.

The same effect as the transport apparatus 10 according to the embodiment described above can be obtained in the case of such a configuration as well.

Embodiment (N)

In the embodiment described above, the mounting position of the pair of side conveyors 12, 13 can be varied by manually adjusting the adjustment mechanism 14 in accordance with the size or the like of the products X to be transported, but it is also possible to adopt a configuration in which the position modification can be automatically controlled.

For example, a configuration is possible in which the movement of the side conveyors 12, 13 along the slide rails 15 is carried out using an actuator 91 such as an electric ball screw and the actuator 91 is controlled by a control computer 95.

Figure 13:
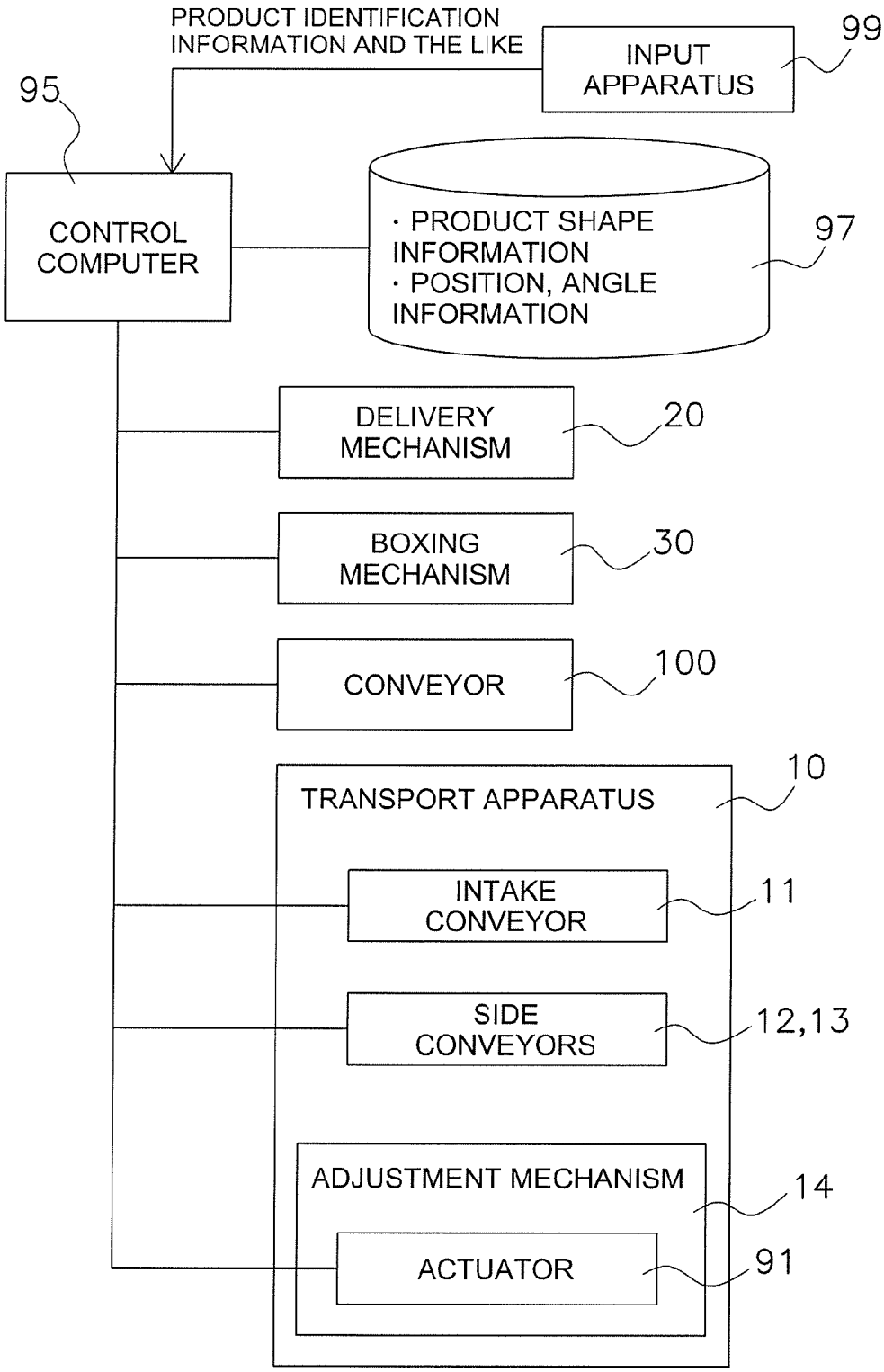
FIG. 13 is a control block diagram of the transport apparatus according to the embodiment (N).

Although not depicted nor described in the embodiment described above, the boxing apparatus 1 of the above embodiments is provided with a control computer 95 for controlling the drive portion of the transport apparatus 10 and each mechanism 20, 30, as shown in FIG. 13. In the present embodiment (N), an example in which the actuator 91 of the adjustment mechanism 14 is controlled using the control computer 95 is shown.

The control computer 95 is composed of a CPU, a ROM, a RAM, and a HDD (hard disk drive) 97 mutually connected via an address bus, a data bus, and other bus lines. Product shape information related to the shape of the product is recorded on the HDD 97 for each type of product. The product shape information may be manually inputted via an input apparatus 99 connected to the control computer 95, or may be externally inputted. The input apparatus 99 is, e.g., an LCD monitor having a touch panel function. The position and angle information of the side conveyors 12, 13 related to the product shape information are stored in the HDD 97.

The control computer 95 acquires product identification information indicating the type of product from the input apparatus 99, and ascertains the corresponding product shape information from the product identification information. The position and angle information of the corresponding side conveyors 12, 13 are determined based on the ascertained product shape information, and the adjustment mechanism 14 is automatically adjusted. In this case, the operator can merely input the product identification information, and the adjustment mechanism 14 of the transport apparatus 10 automatically sets the position and angle of the side conveyors 12, 13 to optimal values.

In this case, processing is carried out via the product shape information, but the product identification information and the position and angle information of the side conveyors 12, 13 may be directly associated. It is also possible to consider a configuration in which the product shape information is inputted from the input apparatus 99.

The invention claimed is:

1. A transport apparatus for transporting an article which is a bag formed from a flexible packaging material, the transport apparatus comprising:

a first transport part configured and arranged to transport the article in a predetermined transport direction with the article being su sported from below by a transport surface of the first transport part; and a second transport part configured and arranged to transport the article in the predetermined transport direction while exerting a downward force on a portion of an upper surface of the article being transported by the first transport part, the second transport part including a pair of transport sections configured and arranged to respectively contact with both ends or portions near both ends of the article in a direction orthogonal to the predetermined transport direction, one of the transport sections of the second transport part having a first transport surface configured and arranged to contact with one of the ends or the portion near the one of the ends of the article, and the other of the transport sections has a second transport surface configured and arranged to contact with the other of the ends or the portion near the other of the ends of the article, and at least one of the first transport surface and the second transport surface of the second transport part forming an acute angle with respect to the transport surface of the first transport part.

2. The transport apparatus as recited in claim 1, wherein each of the first transport surface and the second transport surface of the second transport part forms an acute angle with the transport surface of the first transport part.

3. The transport apparatus as recited in claim 2, wherein the first transport surface of the second transport part forms an acute angle that is 75° or more and 85° or less with respect to the transport surface of the first transport part, and the second transport surface of the second transport part-forms an acute angle that is 75° or more and 85° or less with respect to the transport surface of the first transport part.

4. The transport apparatus as recited in claim 1, further comprising a third transport part configured and arranged to transport the article in the predetermined transport direction while exerting a downward force on the article at a position between the first transport surface and the second transport surface with respect to the direction orthogonal to the predetermined transport direction.

5. The transport apparatus as recited in claim 1, wherein the second transport part has at least one of a conveyor and a roller.

6. The transport apparatus as recited in claim 1, wherein the first transport part and the second transport part are configured and arranged to transport the article with a thickness at a center portion of the article in a height direction in a state of transportation being different from a thickness at the ends of the article in a direction orthogonal to the predetermined transport direction.

7. The transport apparatus as recited in claim 1, further comprising a controller configured to automatically modify at least one of position and the orientation of the second transport part based on article identification information related to a shape of the article.

8. The transport apparatus as recited in claim 1, wherein the first transport surface is a left-side transport surface configured and arranged to contact with a portion of a left side of the article when viewed from an upstream side toward a downstream side of the predetermined transport direction, and the second transport surface is a right-side transport surface configured and arranged to contact with a portion of a right side of the article when viewed from the upstream side toward the downstream side of the predetermined transport direction, the left-side transport surface and the right-side transport surface are each divided into a plurality of units in the predetermined transport direction to form at least a pair of first left-side and right-side transport surfaces and a pair of second left-side and right-side transport surfaces, and the first left-side and right-side transport surfaces have a different orientation from the second left-side and right-side transport surfaces in relation to the transport surface of the first transport part.

9. The transport apparatus as recited in claim 1, wherein the first transport surface is a left-side transport surface configured and arranged to contact with a portion of a left side of the article when viewed from an upstream side toward a downstream side of the predetermined transport direction, and the second transport surface is a right-side transport surface configured and arranged to contact with a portion of a right side of the article when viewed from the upstream side toward the downstream side of the predetermined transport direction, the left-side transport surface and the right-side transport surface are divided into N number of units in the predetermined transport direction to form N number of pairs of left-side and right-side transport surfaces from first left-side and right-side transport surfaces to Nth left-side and right-side transport surfaces, at least one pair from the first left-side and right-side transport surfaces to the Nth left-side and right-side transport surfaces has a different orientation from the other pairs of the left-side and right-side transport surfaces in relation to the transport surface of the first transport part, and a sum of angles formed by the first left-side transport surface to the Nth left-side transport surface with respect to the transport surface of the first transport part is substantially equal to a sum of angles formed by the first right-side transport surface to the Nth right-side transport surface with respect to the transport surface of the first transport part.

10. The transport apparatus as recited in claim 1, wherein the second transport part has a greater transport speed than the first transport part.

11. The transport apparatus as recited in claim 1, further comprising an adjustment mechanism configured and arranged to adjust a mounting position of the second transport part in a direction orthogonal to the predetermined transport direction.

12. A boxing apparatus comprising:

the transport apparatus as recited in claim 1;

a delivery mechanism configured and arranged to receive the articles from the transport apparatus and to sequentially align the articles in an erect orientation in a predetermined position; and a boxing mechanism configured and arranged to box the articles sequentially aligned in the erect orientation in the predetermined position in a predetermined box.

13. A transport apparatus for transporting an article which is a bag formed from a flexible packaging material, the transport apparatus comprising:

a first transport part configured and arranged to transport the article in a predetermined transport direction with the article being supported from below by a transport surface of the first transport part;

a second transport part configured and arranged to transport the article in the predetermined transport direction while exerting a downward force on a portion of an upper surface of the article being transported by the first transport part; and a controller configured to obtain information that associates article identification information for specifying the article with at least one of position and orientation of the second transport part, and to automatically modify the at least one of the position and the orientation of the second transport part based on the article identification information.

* * * * *